US011266879B2

(12) United States Patent
Huang et al.

(10) Patent No.: US 11,266,879 B2
(45) Date of Patent: Mar. 8, 2022

(54) ADAPTIVE ACTIVE TRAINING SYSTEM

(71) Applicant: HIWIN TECHNOLOGIES CORP., Taichung (TW)

(72) Inventors: Yi-De Huang, Taichung (TW); Fu-Han Hsieh, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 263 days.

(21) Appl. No.: 16/798,459

(22) Filed: Feb. 24, 2020

(65) Prior Publication Data

US 2021/0260444 A1 Aug. 26, 2021

(51) Int. Cl.
*A63B 24/00* (2006.01)

(52) U.S. Cl.
CPC ..... *A63B 24/0075* (2013.01); *A63B 24/0062* (2013.01); *A63B 24/0087* (2013.01); *A63B 2024/0068* (2013.01); *A63B 2024/0078* (2013.01); *A63B 2024/0093* (2013.01); *A63B 2220/54* (2013.01); *A63B 2220/56* (2013.01);
(Continued)

(58) Field of Classification Search
CPC ..... A63B 24/0075; A63B 24/0062; A63B 24/0087; A63B 2024/0068; A63B 2024/0078; A63B 2024/0093; A63B 2220/54; A63B 2220/56; A63B 2220/58; A63B 2220/836; A63B 2230/085; A63B 2220/51; A63B 2220/805; A63B 2230/605; A63B 21/0058; A63B 2022/0688; A63B 22/0664; A63B 22/0056; A63B 22/0015; A63B 22/0023; A63B 22/203; A63B 22/0061; A63B 2071/0063; A63B 2210/50; A63B 2230/06; A63B 2230/75; A61H 1/005; A61H 1/0262; A61H 1/00; A61H 2201/0161; A61H 2201/0165; A61H 2201/123; A61H 2201/1635; A61H 2201/164; A61H 2201/1664;
(Continued)

(56) References Cited

U.S. PATENT DOCUMENTS 6,280,363 B1 * 8/2001 Harrell ..... A63B 21/005 482/57
9,248,071 B1 * 2/2016 Benda ..... A63B 22/0664
(Continued)

FOREIGN PATENT DOCUMENTS

CN 102695490 B 9/2015
CN 106109174 B 6/2018
(Continued)

*Primary Examiner* — Sundhara M Ganesan
(74) *Attorney, Agent, or Firm* — Winston Hsu

(57) ABSTRACT

An adaptive active training system includes a motion module, a sensing module and a control module. The motion module includes a training unit and a motor connected to the training unit. The motor is configured to bring the training unit to move along a motion trajectory. The sensing module is configured to sense a physiological signal of a user when the user uses the training unit. The control module is connected to the motion module and the sensing module. The control module is configured to calculate a position of the training unit on the motion trajectory, obtain a threshold value corresponding to the position based on a motion model, and determine whether a magnitude of the physiological signal is greater than the threshold value.

8 Claims, 6 Drawing Sheets

(52) U.S. Cl.
CPC ..... *A63B 2220/58* (2013.01); *A63B 2220/836* (2013.01); *A63B 2230/085* (2013.01)

(58) Field of Classification Search
CPC .... A61H 2201/1676; A61H 2201/1207; A61H 2201/14; A61H 2201/1657; A61H 2205/10
See application file for complete search history.

(56) References Cited

U.S. PATENT DOCUMENTS 9,943,722 B2 * 4/2018 Dalebout ..... A63B 69/16
10,022,587 B1 * 7/2018 Wu ..... A61H 1/005
10,052,252 B2 * 8/2018 Lin ..... G16H 40/63
10,080,915 B2 * 9/2018 Waldner ..... A63B 21/4034
10,736,808 B2 * 8/2020 Benda ..... A61H 1/0237
11,097,158 B2 * 8/2021 Huang ..... A61B 5/6887
11,135,119 B2 * 10/2021 Sulzer ..... A61H 1/0244
2007/0282228 A1 * 12/2007 Einav ..... A63B 21/00178 601/33
2010/0248903 A1 * 9/2010 Cardile ..... A61H 1/0262 482/51
2011/0071442 A1 * 3/2011 Park ..... A61B 5/112 601/35
2013/0245511 A1 * 9/2013 Pidcoe ..... A63B 22/001 601/33
2013/0338549 A1 * 12/2013 Korenaga ..... A61H 99/00 601/33
2014/0087922 A1 * 3/2014 Bayerlein ..... A63B 21/00181 482/54
2014/0100491 A1 * 4/2014 Hu ..... A63B 23/03541 601/27
2014/0371640 A1 * 12/2014 Schorgendorfer ... A61H 1/0262 601/35
2015/0025421 A1 * 1/2015 Wagner ..... A61N 2/006 601/2
2015/0141200 A1 * 5/2015 Murray ..... A63B 22/0087 482/5
2015/0165265 A1 * 6/2015 Tholkes ..... A63B 23/03566 482/54
2015/0297934 A1 * 10/2015 Agrawal ..... A61H 1/0266 482/4
2016/0151659 A1 * 6/2016 Arnold ..... A63B 21/0088 482/4
2016/0213972 A1 * 7/2016 Waldner ..... A61H 1/0262
2017/0157460 A1 * 6/2017 Lin ..... A63B 22/0017
2017/0281999 A1 * 10/2017 Lilley ..... A63B 22/02
2017/0340502 A1 * 11/2017 Roh ..... A63B 23/035
2018/0071580 A1 * 3/2018 Lee ..... A61H 3/00
2018/0104542 A1 * 4/2018 Kwon ..... A61H 1/0262
2018/0110670 A1 * 4/2018 Saglia ..... A63B 21/0058
2018/0111019 A1 * 4/2018 Ellis ..... A63B 22/0023
2019/0001184 A1 * 1/2019 Schindler-Ivens ..... A63B 22/0017
2019/0308054 A1 * 10/2019 Borisoff ..... A63B 21/4009
2020/0078251 A1 * 3/2020 Benda ..... A61H 1/0229
2020/0221975 A1 * 7/2020 Basta ..... A61B 5/112
2020/0360764 A1 * 11/2020 Smith ..... A61H 1/00
2020/0368574 A1 * 11/2020 Bissonnette ..... A63B 23/12
2020/0406097 A1 * 12/2020 Otsuki ..... A61B 5/6887
2021/0005105 A1 * 1/2021 Otsuki ..... A61H 1/00
2021/0008410 A1 * 1/2021 Athanasiou ..... A63B 21/023
2021/0060383 A1 * 3/2021 Huang ..... A63B 24/0062
2021/0086027 A1 * 3/2021 Lin ..... A61H 1/00
2021/0113413 A1 * 4/2021 Pomeroy ..... A63B 21/4034
2021/0137767 A1 * 5/2021 Wang ..... A61H 3/00
2021/0138304 A1 * 5/2021 Mason ..... A63B 24/0062
2021/0401649 A1 * 12/2021 Behnke ..... A61H 3/008

FOREIGN PATENT DOCUMENTS

JP 6175050 8/2017
TW 201924751 A 7/2019
TW M584672 U 10/2019

* cited by examiner

ADAPTIVE ACTIVE TRAINING SYSTEM

BACKGROUND OF THE INVENTION

1. Field of the Invention

The present disclosure relates to an active training system, and more particularly, to an adaptive active training system which can adjust a training intensity based on a physiological signal of a user.

2. Description of the Prior Art

With increase of people's emphasis on health, how to strengthen physical function through training becomes an important issue, which leads to the popularity of various training apparatus and methods.

China patent with Pub. Ser. No. 107280912 A discloses a method for detecting spasm of lower limbs. In the method, the patient's lower limb is placed on a lower limb support frame of a gait rehabilitation machine. The lower limb support frame is driven by a motor to bring the patient's lower limb to rehabilitate. A statistical distribution data is obtained based on the change of the torques outputted by the motor within a predetermined time, and a threshold value is calculated based on the statistical distribution data. During rehabilitation, the torque output by the motor is compared to the threshold value. When the torque output by the motor is greater than the threshold value, it represents that the patient has spasm. However, the method is a passive training method, and the training effect thereof is poor than that of an active training method.

US patent with U.S. Pat. No. 8,147,436 B2 discloses an orthosis, which uses the concept of a virtual elastic force field. A standard model of walking trajectory is established based on a walking trajectory of a healthy person, then the standard model of walking trajectory is used as a force field center to guide a user to move. However, based on the differences between individuals, the standard model of walking trajectory is not applicable to every individual.

US patent with U.S. Pat. No. 9,277,883 B2 discloses a method for controlling a gait-training apparatus using biofeedback. The method detects and analyzes electromyographic signal of a user when the user uses the gait-training apparatus, determines the fatigue degree of the user based on a shift amount of a median frequency of the electromyographic signal, and lowered the training intensity according to the fatigue degree of the user. However, the physiological signal used in the method is limited to the electromyographic signal, and thus cannot be applied widely.

SUMMARY OF THE INVENTION

The present disclosure aims at providing an active training system which can adjust a training intensity based on a physiological signal of a user.

According to one embodiment, an adaptive active training system includes a motion module, a sensing module and a control module. The motion module includes a training unit and a motor connected to the training unit. The motor is configured to bring the training unit to move along a motion trajectory. The sensing module is configured to sense a physiological signal of a user when the user uses the training unit. The control module is connected to the motion module and the sensing module. The control module is configured to calculate a position of the training unit on the motion trajectory, obtain a threshold value corresponding to the position based on a motion model, and determine whether a magnitude of the physiological signal is greater than the threshold value. When the magnitude of the physiological signal is greater than the threshold value, the control module drives the motor to bring the training unit to move along the motion trajectory. When the magnitude of the physiological signal is greater than a product of the threshold value and a magnification ratio, the control module raises the threshold value to an increased threshold value based on a learning rate. When the magnitude of the physiological signal is less than the threshold value, the control module does not drive the motor to bring the training unit to move along the motion trajectory. When the magnitude of the physiological signal is less than a product of the threshold value and a reduction ratio, the control module lowers the threshold value to a decreased threshold value based on the learning rate.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part thereof, and in which is shown by way of illustration specific embodiments in which the disclosure may be practiced. In this regard, directional terminology, such as top, bottom, left, right, front or back, is used with reference to the orientation of the Figure (s) being described. The components of the present disclosure can be positioned in a number of different orientations. As such, the directional terminology is used for purposes of illustration and is in no way limiting. In addition, identical components or similar numeral references are used for identical components or similar components in the following embodiments. It is noted that the term "connected" means that components are able to transmit electrical energy or data such as electric signals, magnetic signals and command signals in direct or indirect, wired or wireless manners. Accordingly, the drawings and descriptions will be regarded as illustrative in nature and not as restrictive.

Figure 1:
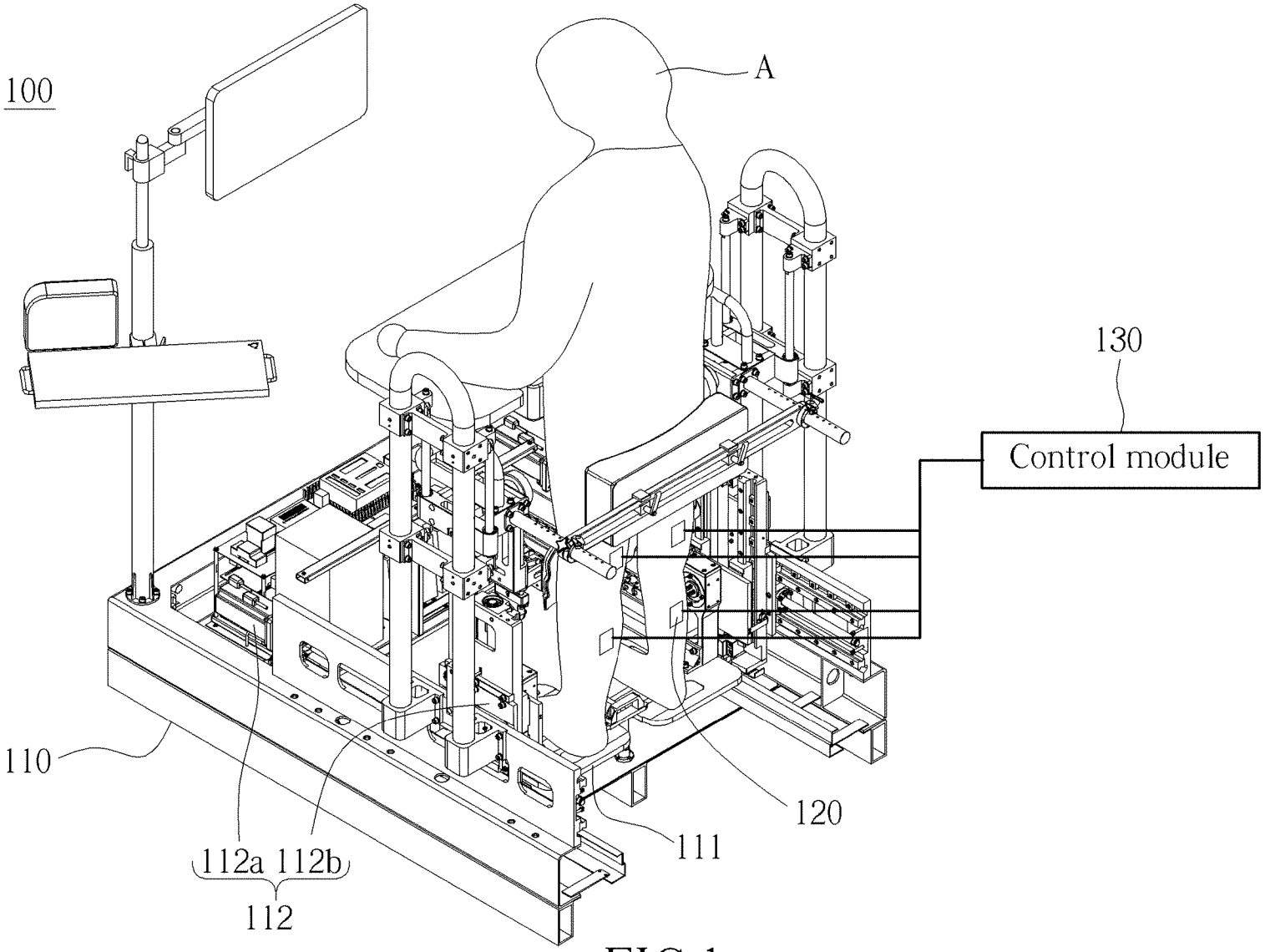
FIG. 1 is a schematic diagram showing an adaptive active training system and a user according to one embodiment of the present disclosure.
Figure 2:
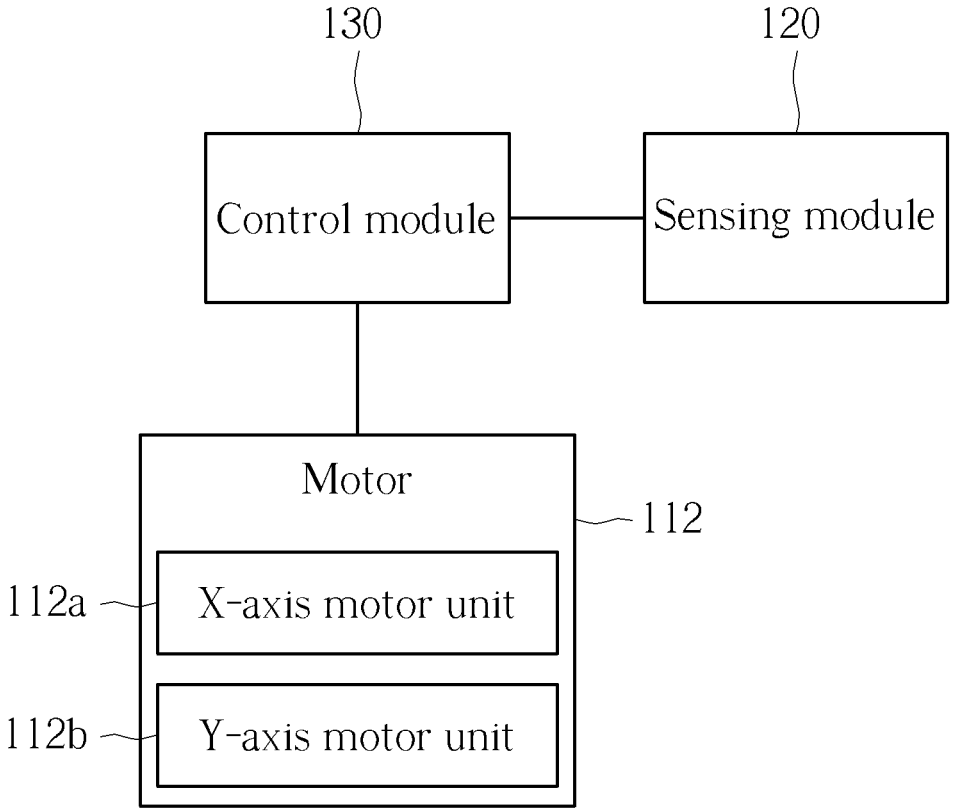
FIG. 2 is a functional block diagram of the adaptive active training system according to the embodiment of the present disclosure.

Please refer to FIG. 1 and FIG. 2. An adaptive active training system 100 includes a motion module 110, a sensing module 120 and a control module 130. The motion module 110 includes a training unit 111 and a motor 112. The motor 112 includes an X-axis motor unit 112*a* and a Y-axis motor unit 112*b*. The motor 112 is connected to the training unit 111 and is configured to bring the training unit 111 to move along the motion trajectory. The sensing module 120 is configured to sense a physiological signal of a user A when the user A uses the training unit 111. The control module 130 is connected to the motion module 110 and the sensing module 120.

In FIG. 1, the motion module 110 is a gait-training apparatus, which is only exemplary. In the present disclosure, the motion module 110 can be a rehabilitation apparatus for helping the user A to recover the movement ability which is impaired or lost due to illness or trauma. The motion module 110 can also be a weight training apparatus for enhancing the muscle strength or the muscle endurance of the user A. The training unit 111 is the part of the motion module 110 which is configured to be operated or driven by the user A. Taking FIG. 1 as the example, the training unit 111 is a pedal, such that the legs and/or the feet of the user A can be trained. In other embodiment, the motion module 110 can be arranged with different types of training unit 111 according to the part which the user A is desired to be trained.

In FIG. 1, the sensing module 120 is an electromyographic sensor for sensing an electromyographic signal when the user A uses the training unit 111. Specifically, the electromyographic sensor can be the electrode patch attached to the legs of the user A, which can collect the electromyographic signal of the legs of the user A. However, it is only exemplary. In other embodiment, the sensing module 120 can be a pressure sensor (not shown) for sensing a pressure applied by the user A to the training unit 111. For example, the pressure sensor can be disposed on the pedal for sensing the pressure applied by the user A to the pedal. Alternatively, the sensing module 120 can be a torque sensor (not shown) connected to the motor 112. The torque sensor is for sensing a torque of the motor 112 when the user A uses the training unit 111. In other words, the physiological signal can be the electromyographic signal, the pressure, the torque or other signal which can present the physiological state of the user A. Moreover, the types of the sensing module 120 can be selected based on the types of the physiological signal. The control module 130 is capable of analysis and calculation. The control module 130 can be, but is not limited to, a central processing unit (CPU).

Figure 3:
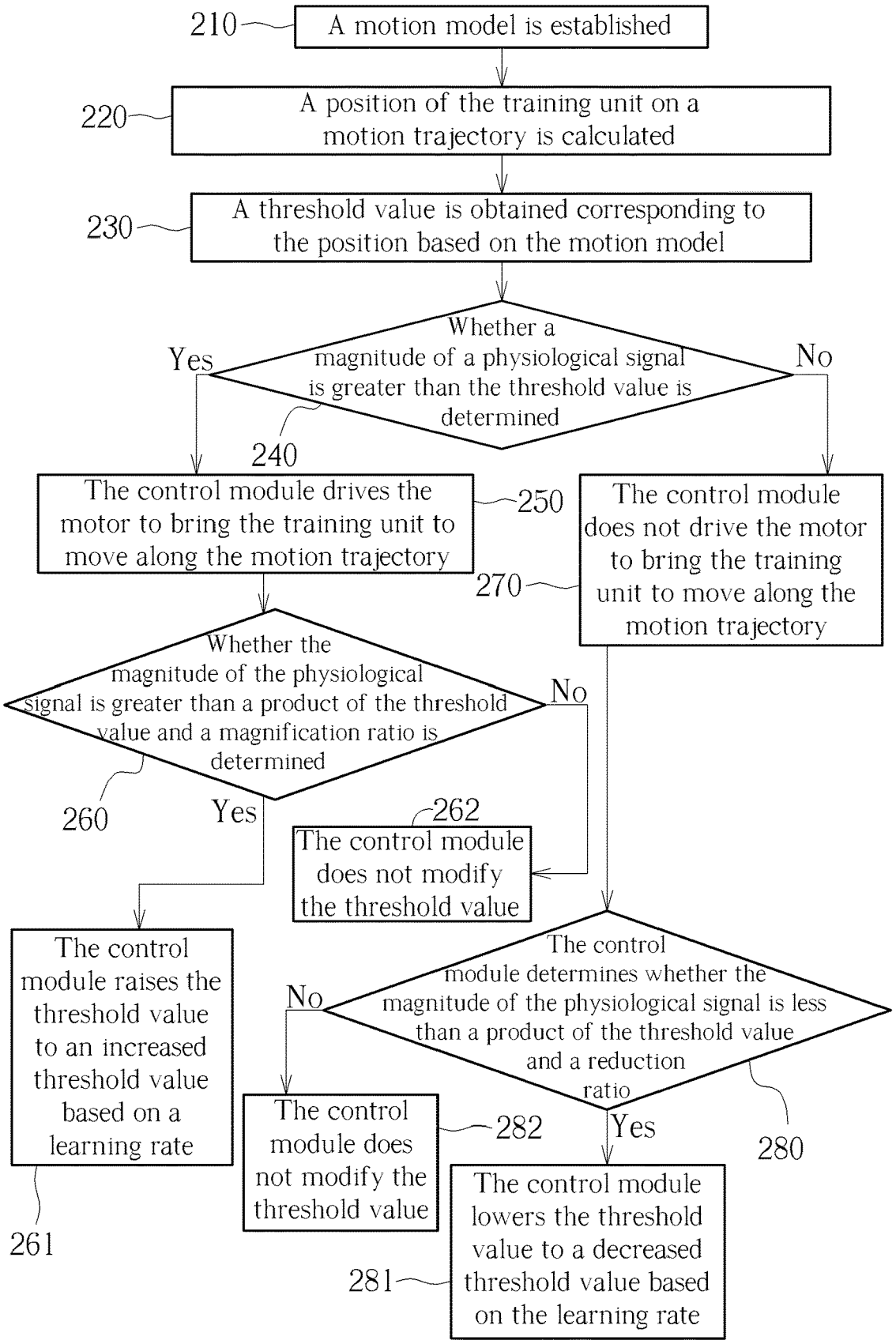
FIG. 3 is a flow chart illustrating a control module configured to control the motion module.

In FIG. 3, the control module 130 is configured to conduct the following steps. In Step 210, a motion model is established. In Step 220, a position of the training unit 111 on the motion trajectory is calculated. In Step 230, a threshold value is obtained corresponding to the position based on the motion model. In Step 240, whether a magnitude of the physiological signal is greater than the threshold value is determined; if yes, i.e., the magnitude of the physiological signal is greater than the threshold value, go to Step 250, the control module 130 drives the motor 112 to bring the training unit 111 to move along the motion trajectory. In Steps 260, whether the magnitude of the physiological signal is greater than a product of the threshold value and a magnification ratio is determined; if yes, i.e., the magnitude of the physiological signal is greater than the product of the threshold value and the magnification ratio, go to Step 261, the control module 130 raises the threshold value to an increased threshold value based on a learning rate; if no, i.e., the magnitude of the physiological signal is less than or equal to the product of the threshold value and the magnification ratio, go to Step 262, the control module 130 does not modify the threshold value. In practical, Steps 250 and 260 can be conducted at the same time.

Figure 4:
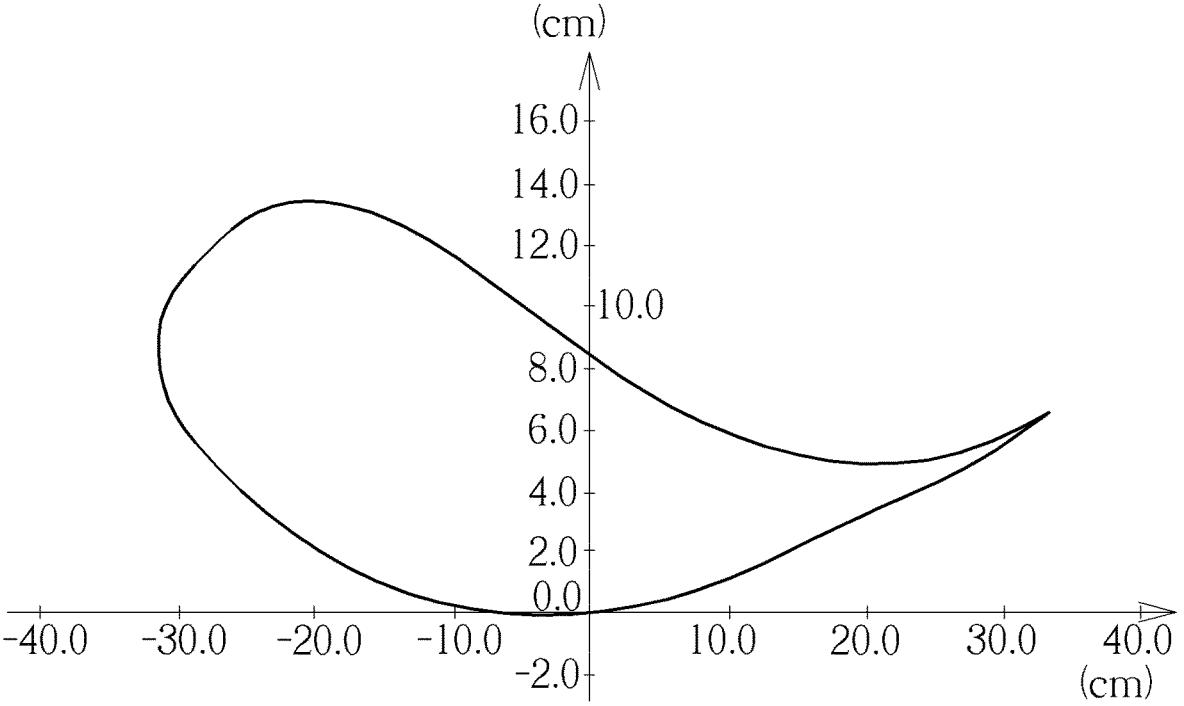
FIG. 4 is a schematic diagram showing a motion trajectory according to one embodiment of the present disclosure.
Figure 5:
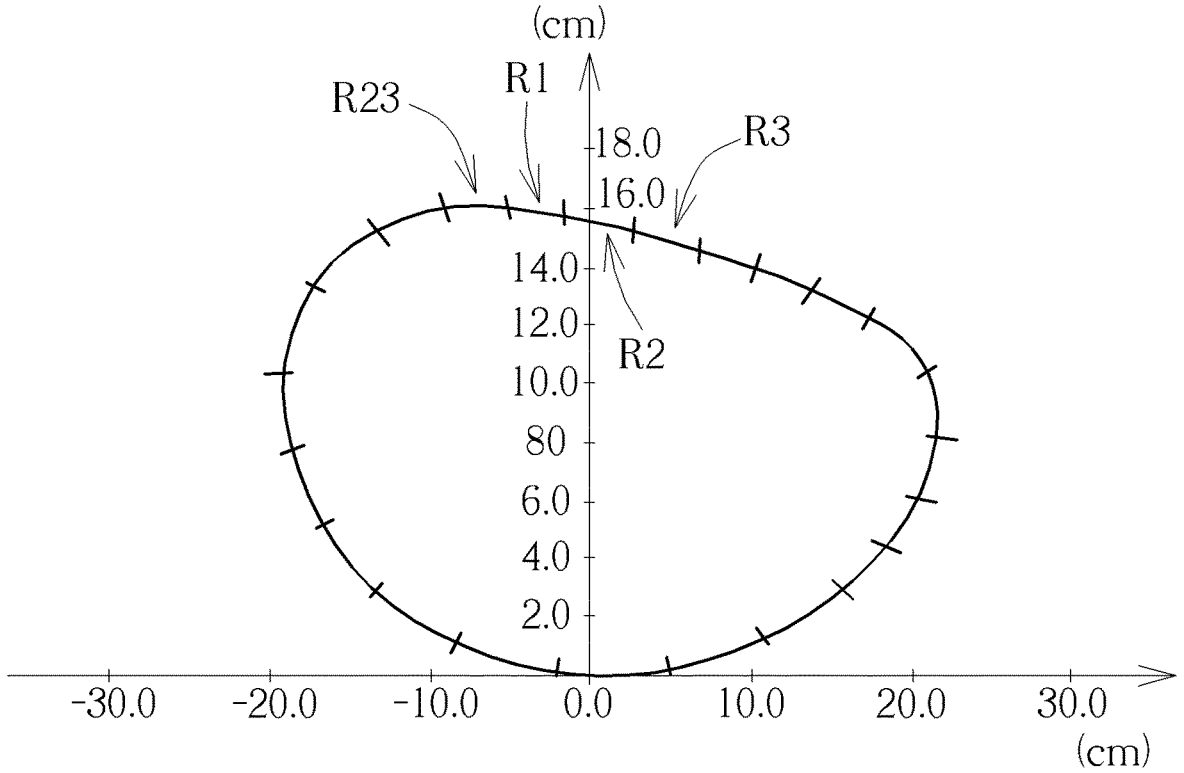
FIG. 5 is a schematic diagram showing a motion trajectory according to another embodiment of the present disclosure.

Specifically, the motion module 110 can provide a variety of motion modes according to practical needs. Taking the gait-training apparatus of FIG. 1 as the example, the training unit 111 (i.e., the pedal) can be configured to move along different motion trajectories. Please refer to FIG. 4 and FIG. 5, the horizontal axis represents a horizontal position of the training unit 111, the vertical axis represents a vertical position of the training unit 111, and both of the units of the horizontal axis and the vertical axis are centimeters. In FIG. 4, the motion trajectory is a walking trajectory. In FIG. 5, the motion trajectory is an elliptical trajectory. Comparing to the motion trajectory of FIG. 4, the motion trajectory of FIG. 5 has a higher vertical displacement, which can strengthen the flexibility of legs along the vertical direction. However, FIG. 4 and FIG. 5 are exemplary, and the present disclosure is not limited thereto. Furthermore, how to arrange the training unit 111 to move along different trajectories is well known in the art and is omitted herein.

Figure 6:
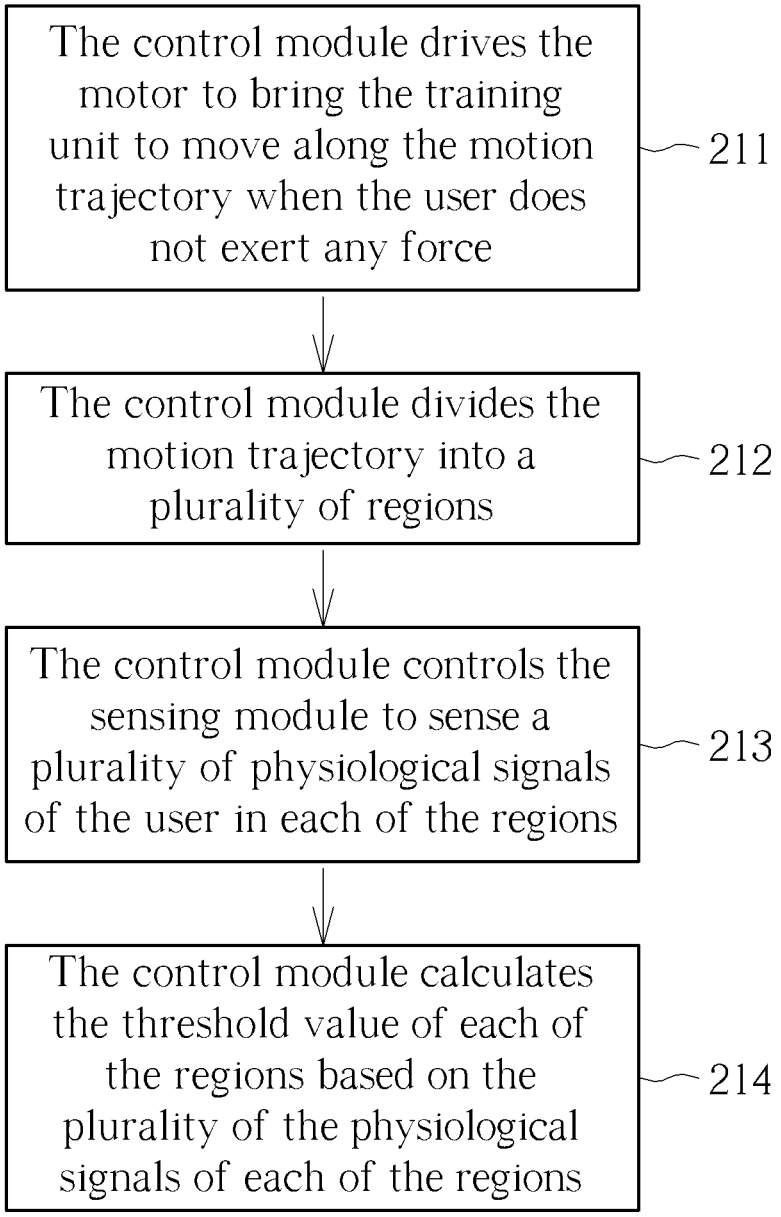
FIG. 6 is a flow chart of establishing the motion model according to one embodiment of the present disclosure.

Before actual training begins, the motion model suitable for the user A can be established. Please refer to FIG. 6. In Step 211, the control module 130 drives the motor 112 to bring the training unit 111 to move along the motion trajectory when the user A does not exert any force, such that a portion (herein, the foot) of the user A is driven by the training unit 111 to move along the motion trajectory. The following illustration is using the motion trajectory of FIG. 5 as the example.

In Step 212, the control module 130 divides the motion trajectory into a plurality of regions. For example, when the motion trajectory is divided into n regions, each of the regions is named as Ri, i is a positive integer from 1 to n. Taking FIG. 5 as the example, the motion trajectory is divided into 23 regions. The regions are named as R1-R23. In FIG. 5, only R1, R2, R3 and R23 are labeled, which is exemplary.

In Step 213, the control module 130 controls the sensing module 120 to sense a plurality of physiological signals of the user A in each of the regions. The plurality of the physiological signals in each of the regions can be obtained in one motion circle of the training unit 111, wherein "one motion circle" refers that the training unit 111 takes a lap around the motion trajectory. That is, the plurality of the physiological signals in each of the regions can be obtained when the training unit 111 only takes a lap around the motion trajectory (i.e., the number of the samples is greater than the number of the regions). For example, when the number of the regions is 100, the number of the samples is 200, and the number of the physiological signals in each of the regions is 2. Alternatively, the plurality of the physiological signals in each of the regions can be obtained in a plurality of motion circles of the training unit 111. For example, in each motion circle of the training unit 111, only one physiological signal in each of the regions is obtained (i.e., the number of the samples is equal to the number of the regions). When the training unit 111 takes a plurality of laps around the motion trajectory, the plurality of the physiological signal in each of the regions can be obtained. Alternatively, the plurality of the physiological signal in each of the regions can be obtained in a plurality of motion circles of training unit 111. First, a plurality physiological signals in each of the regions is obtained in one motion circle of the training unit 111 (i.e., the number of the samples is greater than the number of the regions), and a arithmetic mean of the magnitudes of the plurality of the physiological signals in each of the regions is calculated to represent the physiological signal in each of the regions. When the training unit 111 takes a plurality of laps around the motion trajectory, a plurality of arithmetic means can be obtained. That is, the plurality of the physiological signals in each of the regions of Step 213 can be the arithmetic means.

In Step 214, the control module 130 calculates the threshold value of each of the regions based on the plurality of the physiological signals in each of the regions. According to one embodiment of the present disclosure, the threshold value can be calculated by Formula (I):

$$Vth=\overline{S}i+2\sigma i \quad \text{(I).}$$

In Formula (I), Vth is a threshold value of the region Ri, $\overline{S}i$ is an arithmetic mean of the magnitudes of the plurality of the physiological signals in the region Ri, $\sigma i$ is a standard deviation of the magnitudes of the plurality of the physiological signals in the region Ri. Specifically, when m physiological signals are obtained in each of the regions, the magnitude of each of the physiological signals is Sij, j is a positive integer from 1 to m. For example, if m=3, the magnitudes of the plurality of the physiological signals in the region R1 are S11, S12 and S13, the magnitudes of the plurality of the physiological signals in the region R2 are S21, S22 and S23, and so on. $\overline{S}i$ can be calculated by Formula (II), $\sigma i$ can be calculated by Formula (III):

$$\overline{S}i=\frac{\sum_{j=1}^{m} Sij}{m}; \quad \text{(II)}$$

$$\sigma i=\sqrt{\frac{1}{m}\sum_{j=1}^{m}(Sij-\overline{S}i)^2}. \quad \text{(III)}$$

As such, the adaptive active training system 100 of the present disclosure can establish the motion model suitable for the user A.

When the actual training begins, the control module 130 calculates the position of the training unit 111 on the motion trajectory (Step 220). For example, the position can be calculated through an encoder connected to the motor 112. The encoder can be an absolute encoder. For example, the model of the encoder can be MHMD082S1V. How to obtain the position of the training unit 111 is well known in the art and is not recited herein. With the position of the training unit 111, the region of the motion trajectory where the training unit 111 located can be decided, and the threshold value corresponding to the region can be obtained through the motion model (Step 230). When the magnitude of the physiological signal of the user A is greater than the threshold value, the control module 130 drives the motor 112 to bring the training unit 111 to move along the motion trajectory (Step 250). That is, the adaptive active training system 100 of the present disclosure is a kind of active training system. At the same time, the control module 130 determines whether the magnitude of the physiological signal is greater than a product of the threshold value and a magnification ratio, i.e., whether the magnitude of the physiological signal satisfies Formula (IV), wherein Sc is the magnitude of the current physiological signal, $\gamma$ is the magnification ratio, and $\gamma$ is a real number greater than 1:

$$Sc>Vth\times\gamma \quad \text{(IV).}$$

When the determination is "No", it represents that although the magnitude of the current physiological signal Sc is greater than the threshold value Vth, the difference between the magnitude of the current physiological signal Sc and the threshold value Vth is acceptable. The training still can help the user A, and the control module 130 does not modify the threshold value (Step 262). When the determination is "Yes", it represents that the magnitude of the current physiological signal Sc is much greater than the threshold value Vth. The training is too easy and cannot help the user A, the control module 130 raises the threshold value to an increased threshold value (Step 261). The increased threshold value can be calculated by Formula (V):

$$Vin=Vth\times(1+\eta) \quad \text{(V).}$$

In Formula (V), Vin is the increased threshold value, $0<\eta<1$, and $\eta$ is a real number. For example, $\eta$ can be 0.3, 0.4 or 0.5.

Figure 7:
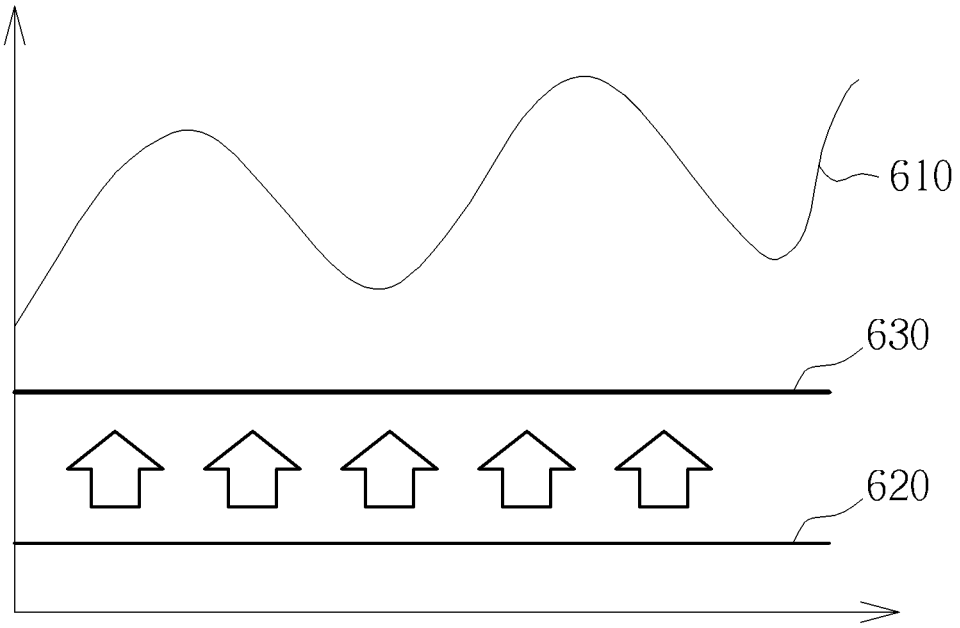
FIG. 7 is a schematic diagram showing modification of the threshold value according to one embodiment of the present disclosure.

Please refer to FIG. 7, wherein the horizontal axis represents the position of the training unit 111, the vertical axis represents the magnitude of the physiological signal. Line 610 represents the magnitudes of the physiological signals of different positions of one region of the motion trajectory. Line 620 is the threshold value of the region. Line 630 is the increased threshold value of the region. As such, the training intensity can be adjusted based on the current physical state of user A. Preferably, the increased threshold value is less than or equal to the magnitude of the physiological signal. As such, it can prevent the training intensity from being adjusted too high to exceed the load that the user A can bear.

Please refer to FIG. 3. In Step 240, when the control module 130 determines that the magnitude of the physiological signal is less than the threshold value, go to Step 270. In Step 270, the control module 130 does not drive the motor 112 to bring the training unit 111 to move along the motion trajectory. That is, the force exerted by the user A is not sufficient to drive the training unit 111 to move. In Step 280, the control module 130 determines whether the magnitude of the physiological signal is less than a product of the threshold value and a reduction ratio, i.e., whether the magnitude of the physiological signal satisfies Formula (VI), wherein Sc is the magnitude of the current physiological signal, a is the reduction ratio, $0<\alpha<1$, and $\alpha$ is a real number:

$$Sc<Vth\times\alpha \quad \text{(VI).}$$

When the determination is "No", it represents that although the magnitude of the current physiological signal Sc is less than the threshold value Vth, the difference between the magnitude of the current physiological signal Sc and the threshold value Vth is acceptable, there is still a chance for the user A to reach the threshold value by increasing the exerting force. In the situation, go to Step 282, the control module 130 does not modify the threshold value. When the determination is "Yes", it represents that training intensity is too high to the user A. In this situation, go to Step 281, the control module 130 lowers the threshold value to a decreased threshold value based on the learning rate. The decreased threshold value can be calculated by Formula (VII):

$$Vde=Vth\times(1-\eta) \quad \text{(VII).}$$

In Formula (VII), Vde is the decreased threshold value, the definition of η is mentioned above and is not repeated herein. Moreover, Steps 270 and 280 can be conducted at the same time.

Figure 8:
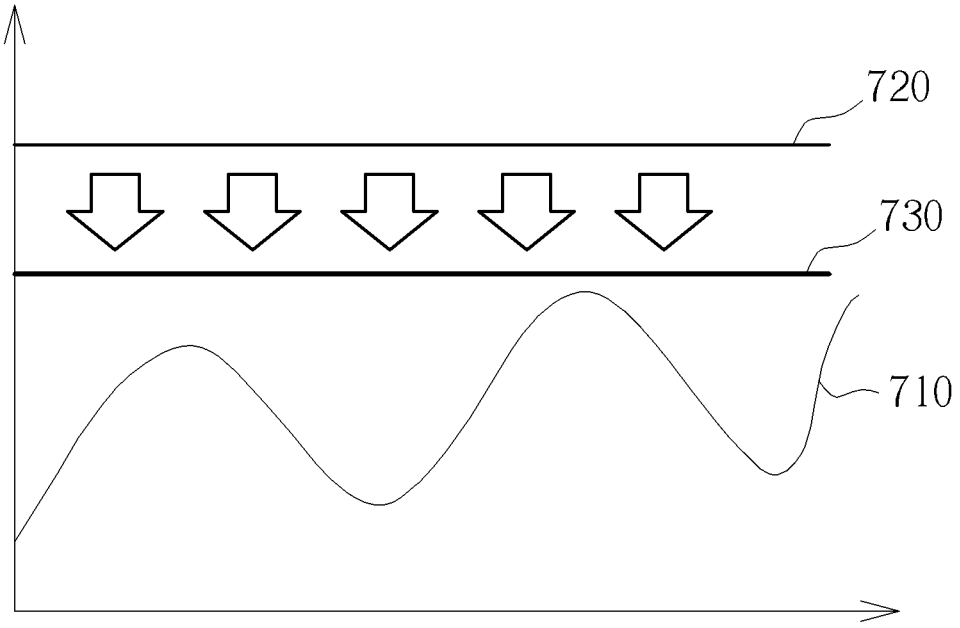
FIG. 8 is a schematic diagram showing modification of the threshold value according to another embodiment of the present disclosure.

Please refer FIG. 8, wherein the horizontal axis represents the position of the training unit 111, the vertical axis represents the magnitude of the physiological signal. Line 710 represents the magnitudes of the physiological signals corresponding to different positions of one region of the motion trajectory. Line 720 is the threshold value of the region. Line 730 is the decreased threshold value of the region. As such, the training intensity can be reduced according to the current physical state of user A. Preferably, the decreased threshold value is greater than or equal to the magnitude of the physiological signal. As such, it can prevent the training intensity from being adjusted too low, which allows the user A to complete the training easily and loses the training effect.

Comparing to prior art, the adaptive active training system of the present disclosure is a kind of active training system, which can provide better training effect than a passive training system. The physiological signal used in the adaptive active training system of the present disclosure is not limited to an electromyographic signal, and thus can be used widely. The adaptive active training system of the present disclosure can raise or lower the threshold value based on the current physiological signal of the user. On one hand, it can prevent the threshold value is too high to exceed the load that the user can bear, and thus can prevent the training willingness of the user from being reduced. On the other hand, it can prevent the threshold value is too low to provide sufficient training intensity. Accordingly, the adaptive active training system of the present disclosure can provide progressive overload training, which can enhance the training effect significantly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An adaptive active training system, comprising:
- a motion module, comprising:
  - a training unit; and
  - a motor connected to the training unit, the motor being configured to bring the training unit to move along a motion trajectory;
- a sensing module configured to sense a physiological signal of a user when the user uses the training unit; and
- a control module connected to the motion module and the sensing module, the control module being configured to:
  - calculate a position of the training unit on the motion trajectory;
  - obtain a threshold value corresponding to the position based on a motion model; and
  - determine whether a magnitude of the physiological signal is greater than the threshold value, wherein:
    - when the magnitude of the physiological signal is greater than the threshold value, the control module drives the motor to bring the training unit to move along the motion trajectory;
    - when the magnitude of the physiological signal is greater than a product of the threshold value and a magnification ratio, the control module raises the threshold value to an increased threshold value based on a learning rate;
    - when the magnitude of the physiological signal is less than the threshold value, the control module does not drive the motor to bring the training unit to move along the motion trajectory; and
    - when the magnitude of the physiological signal is less than the product of the threshold value and a reduction ratio, the control module lowers the threshold value to a decreased threshold value based on the learning rate.

2. The adaptive active training system of claim 1, wherein the upper threshold value is less than or equal to the magnitude of the physiological signal, and the lower threshold value is greater than or equal to the magnitude of the physiological signal.

3. The adaptive active training system of claim 1, wherein the threshold value is Vth, the increased threshold value is Vin, and the learning rate is η, the following relationship is satisfied:

$$Vin=Vth\times(1+\eta);\text{ and}$$

$0<\eta<1$, η is a real number.

4. The adaptive active training system of claim 1, wherein the threshold value is Vth, the decreased threshold value is Vde, and the learning rate is η, the following relationship is satisfied:

$$Vde=Vth\times(1-\eta);\text{ and}$$

$0<\eta<1$, η is a real number.

5. The adaptive active training system of claim 1, wherein the control module is further configured to:
- establish the motion model, comprising:
  - the control module driving the motor to bring the training unit to move along the motion trajectory when the user does not exert any force, such that a portion of the user is driven by the training unit to move along the motion trajectory;
  - the control module dividing the motion trajectory into a plurality of regions;
  - the control module controlling the sensing module to sense a plurality of physiological signals of the user in each of the regions; and
  - the control module calculates the threshold value of each of the regions based on the plurality of the physiological signals of the user in each of the regions.

6. The adaptive active training system of claim 1, wherein the sensing module is a pressure sensor for sensing a pressure applied by the user to the training unit, so as to generate the physiological signal.

7. The adaptive active training system of claim 1, wherein the sensing module is an electromyographic sensor for sensing an electromyographic signal when the user uses the training unit, so as to generate the physiological signal.

8. The adaptive active training system of claim 1, wherein the sensing module is a torque sensor connected to the motor, the torque sensor is for sensing a torque of the motor when the user uses the training unit, so as to generate the physiological signal.

* * * * *